US008596630B2

(12) United States Patent
Kato et al.

(10) Patent No.: US 8,596,630 B2
(45) Date of Patent: Dec. 3, 2013

(54) SHEET PROCESSING APPARATUS THAT FLATTENS FOLDED SPINE OF SHEET BUNDLE AND IMAGE FORMING APPARATUS INCLUDING THE SHEET PROCESSING APPARATUS

(75) Inventors: Hitoshi Kato, Toride (JP); Naoki Ishikawa, Kashiwa (JP); Yasuo Fukatsu, Abiko (JP); Tomoharu Sato, Abiko (JP)

(73) Assignee: Canon Kabushiki Kaisha (JP)

( * ) Notice: Subject to any disclaimer, the term of this patent is extended or adjusted under 35 U.S.C. 154(b) by 3 days.

(21) Appl. No.: 13/432,168

(22) Filed: Mar. 28, 2012

(65) Prior Publication Data

US 2012/0252649 A1 Oct. 4, 2012

(30) Foreign Application Priority Data

Mar. 30, 2011 (JP) ..... 2011-075645

(51) Int. Cl.
*B31F 1/00* (2006.01)

(52) U.S. Cl.
USPC ..... 270/45; 270/32; 270/58.07

(58) Field of Classification Search
USPC ..... 270/32, 45, 51, 58.07; 493/406, 407, 493/442, 454
See application file for complete search history.

(56) References Cited

U.S. PATENT DOCUMENTS 7,802,779 B2 * 9/2010 Kamiya ..... 270/45
7,922,162 B2 * 4/2011 Kamiya ..... 270/45
8,439,341 B2 * 5/2013 Ishikawa et al. ..... 270/45

FOREIGN PATENT DOCUMENTS

JP 2006-036493 A 2/2006

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which is capable of stabilizing a stop position of the sheet bundle, to thereby enable creation of a high finish quality product, and is compact in size and can be manufactured at low costs. Conveyance belts convey the sheet bundle to a flattening position. A pressing roller flattens the folded spine of the sheet bundle by pressing the folded spine. Clampers hold the sheet bundle such that the sheet bundle is not moved when flattening is performed. A CPU starts to stop driving of the conveyance belts when the sheet bundle is conveyed to a predetermined location upstream of the flattening position in the conveying direction of the sheet bundle, and stops the sheet bundle at the flattening position by holding the sheet bundle with the clampers before the conveyance of the sheet bundle is stopped.

6 Claims, 7 Drawing Sheets

SHEET PROCESSING APPARATUS THAT FLATTENS FOLDED SPINE OF SHEET BUNDLE AND IMAGE FORMING APPARATUS INCLUDING THE SHEET PROCESSING APPARATUS

BACKGROUND OF THE INVENTION

1. Field of the Invention

The present invention relates to a sheet processing apparatus that performs post processing on a bent portion of a folded sheet bundle formed by folding sheets stacked one upon another, and more particularly to a sheet processing apparatus that flattens a folded spine portion of a saddle-stitched sheet bundle to thereby improve the appearance of the sheet bundle, and an image forming apparatus including the sheet processing apparatus.

2. Description of the Related Art

Some image forming apparatuses are provided with a sheet processing apparatus for performing folding processing and the like on sheets having images formed thereon by an image forming section. Further, some sheet processing apparatuses of this type perform processing for folding a sheet bundle and then flattening a curved folded spine, which is a bent portion of the folded sheet bundle, so as to improve the quality of the folded spine and stackability of the sheet bundle (see e.g. Japanese Patent Laid-Open Publication No. 2006-36493).

In the conventional sheet processing apparatus, flattening of the folded spine is performed by the following steps: In a first step, the folded sheet bundle is conveyed by conveying rollers, and the curved folded spine of the sheet bundle is brought into abutment with a positioning member, for positioning of the sheet bundle. In a second step, a portion of the sheet bundle close to the folded spine is clamped and fixed by a holding member, and then the positioning member is retracted. In a third step, the folded spine is flattened by causing a pressing roller to travel along the curved folded spine of the sheet bundle while urging the pressing roller against the curved folded spine. In this flattening step, by changing the position of the positioning member in a conveying direction of the sheet bundle, it is possible to adjust the amount of crushing of the folded spine into a flat state.

In the conventional sheet processing apparatus, however, the positioning member, a mechanism for retracting the positioning member, and a mechanism for moving the positioning member in the conveying direction are required, which increases the size and costs of the sheet processing apparatus.

As a solution to the inconveniences, it is envisaged to configure the sheet processing apparatus such that the sheet bundle is stopped by stopping the driving of the conveying rollers, and thereby omit the positioning member and the mechanisms for retracting and moving the positioning member to reduce the number of component parts and simplify the structure of the sheet processing apparatus, and thereby reduce the size and costs of the sheet processing apparatus.

However, in a case where the sheet processing apparatus is configured such that the sheet bundle is stopped by stopping the driving of the conveying rollers, as described above, an error in the stop position of the sheet bundle increases due to variation in a braking distance over which the sheet bundle is moved when a motor for driving the conveying rollers is stopped and a play of a driving mechanism. Therefore, when the sheet processing apparatus is configured as described above, the amount of crushing of the folded spine of the sheet bundle is unstable to cause variation in finish quality.

SUMMARY OF THE INVENTION

The present invention provides a sheet processing apparatus which is capable of stabilizing an amount of crushing of a folded spine of a sheet bundle by stabilizing a stop position of the sheet bundle, to thereby enable creation of a high finish quality product, and further which is compact in size and can be manufactured at low costs, and an image forming apparatus including the sheet processing apparatus.

In a first aspect of the present invention, there is provided a sheet processing apparatus that flattens a curved folded spine which is a bent portion of a folded sheet bundle formed by folding sheets stacked one upon another, comprising a conveyance unit configured to convey the sheet bundle to a flattening position at which flattening of the folded spine of the sheet bundle is performed, a flattening unit configured to press the folded spine of the sheet bundle positioned at the flattening position to thereby flatten the folded spine, a holding unit provided independently of the conveyance unit and configured to hold the sheet bundle such that the sheet bundle is not moved when the flattening unit performs flattening, and a control unit configured to stop a driving signal for driving the conveyance unit when the sheet bundle is conveyed to a predetermined location upstream of the flattening position in a conveying direction of the sheet bundle, and hold the sheet bundle with the holding unit before the conveyance of the sheet bundle is stopped, to thereby stop the sheet bundle at the flattening position.

In a second aspect of the present invention, there is provided a sheet processing apparatus that flattens a curved folded spine which is a bent portion of a folded sheet bundle formed by folding sheets stacked one upon another, comprising a conveyance unit configured to convey the sheet bundle to a flattening position at which flattening of the folded spine of the sheet bundle is performed, a holding unit configured to hold the sheet bundle conveyed to the flattening position by the conveyance unit, a sheet bundle detection sensor that detects the sheet bundle being conveyed by the conveyance unit, a conveyance control unit configured to determine timing for starting a stop control for stopping the sheet bundle at the flattening position based on detection of the sheet bundle by the sheet bundle detection sensor, and stop a driving signal for driving the conveyance unit at the determined timing, an sheet bundle information acquisition unit configured to acquire information on the sheet bundle, an arrival time acquisition unit configured to acquire an arrival time taken for the sheet bundle to reach the flattening position after a time point when the stop control unit stops the driving signal, based on the information on the sheet bundle acquired by the sheet bundle information acquisition unit, a holding time acquisition unit configured to acquire a holding time taken for the holding unit to hold the sheet bundle after a time point when the holding unit starts an operation for holding the sheet bundle, based on the information on the sheet bundle acquired by the sheet bundle information acquisition unit, and a holding control unit configured to cause the holding unit to start a clamping operation, based on a difference between the arrival time acquired by the arrival time acquisition unit and the holding time acquired by the holding time acquisition unit, to thereby cause the sheet bundle to be held and stopped at the flattening position.

In a third aspect of the present invention, there is provided an image forming apparatus comprising an image forming apparatus comprising an image forming unit configured to form an image on a sheet, a folding unit configured to fold a sheet bundle formed by a plurality of sheets each having images formed thereon by the image forming unit, a conveyance unit configured to convey the sheet bundle to a flattening position at which flattening of a folded spine of the sheet bundle folded by the holding unit is performed, a flattening unit configured to press the folded spine of the sheet bundle positioned at the flattening position to thereby flatten the folded spine, a holding unit provided separately from the conveyance unit and configured to hold the sheet bundle such that the sheet bundle is not moved when the flattening unit performs flattening, and a control unit configured to stop a driving signal for driving the conveyance unit when the sheet bundle is conveyed to a predetermined location upstream of the flattening position in a conveying direction of the sheet bundle, and hold the sheet bundle with the holding unit before the conveyance of the sheet bundle is stopped, to thereby stop the sheet bundle at the flattening position.

According to the present invention, the stop position of a sheet bundle is stabilized using the holding unit that holds the sheet bundle to be subjected to flattening by clamping. This makes it possible to provide an inexpensive sheet processing apparatus simple in construction which is capable of stably positioning and stopping a sheet bundle, and creating a product having a high finish quality, by stabilizing the amount of crushing of a folded spine of the sheet bundle, and an image forming apparatus including the sheet processing apparatus.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
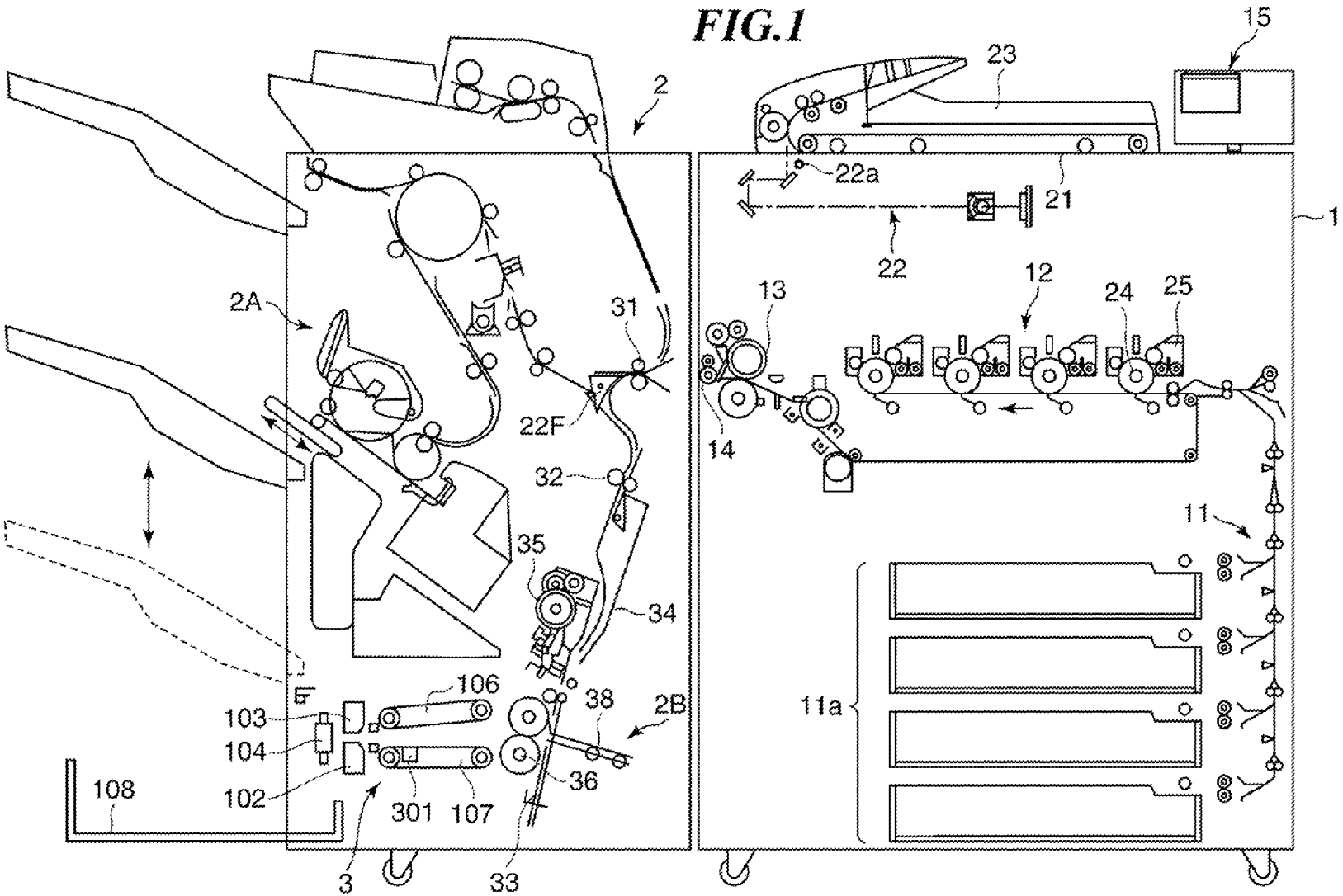
FIG. 1 is a schematic view useful in explaining an image forming apparatus including a sheet processing apparatus according to an embodiment of the present invention.

FIG. 1 shows an image forming apparatus which is an example of an image forming apparatus including a sheet processing apparatus according to an embodiment of the present invention.

In FIG. 1, reference numeral 1 denotes the image forming apparatus. The image forming apparatus 1 includes a platen glass 21 as a document placing platform, a light source 22*a*, an optical system 22, a sheet feeder 11, an image forming section 12, a document feeder 23 for feeding original documents to the platen glass 21, an operation and display unit 15, and so forth.

The sheet feeder 11 comprises cassettes 11*a* each of which accommodates recording sheets and is removably mounted on the image forming apparatus 1. Further, the image forming section 12 comprises a hollow cylindrical photosensitive drum 24, a developing device 25, a fixing device 13, and the like. Furthermore, a discharge roller pair 14 is disposed at a location downstream of the image forming section 12. The image forming apparatus 1 forms an image on a recording sheet fed to the image forming section 12 from the sheet feeder 11, and discharges the recording sheet using the discharge roller pair 14.

The image forming apparatus 1 further comprises a sheet processing apparatus 2 that processes image formed sheets discharged from the image forming apparatus 1.

The sheet processing apparatus 2 includes a stapling section 2A that staples, sheets the image formed sheets discharged from the image forming apparatus 1. Further, the sheet processing apparatus 2 includes a bookbinding section 2B that performs bookbinding of a sheet bundle by folding the same in two, and a flattening section 3 that selectively performs flattening of a folded spine of the sheet bundle having been subjected to the bookbinding by the bookbinding section 2B. The sheet processing apparatus 2 includes an inlet roller 31 that receives and conveys a sheet discharged from the image forming apparatus 1, and a flapper 22F that switches the conveying destination of the received sheet according to a processing mode. In a case where a bookbinding processing mode is set, the sheet processing apparatus 2 causes the flapper 22F to switch the conveying destination to guide each sheet toward the bookbinding section 2B. Thereafter, each sheet thus guided is conveyed by a conveying roller 32 until it is brought into abutment with a stopper 33. The sheet processing apparatus 2 repeatedly performs the above-described operations and stop sequentially conveyed sheets with the stopper 33 to thereby form a sheet bundle within a conveying path 34.

Next, the sheet processing apparatus 2 selectively stitches a central portion of the sheet bundle formed within the conveying path 34, using a stapler 35. After that, the sheet processing apparatus 2 causes the stopper 33 to move the sheet bundle until the center of the sheet bundle coincides with the thrust position of a thrust plate 38, for positioning the sheet bundle. Then, the central portion of the sheet bundle thus positioned is thrust by the thrust plate 38, whereby the center of the sheet bundle is bent and pushed in between a folding roller pair 36 as a folding unit, and is folded in two. The sheet bundle thus folded in two is conveyed to the flattening section 3 by the folding roller pair 36.

Figure 2A:
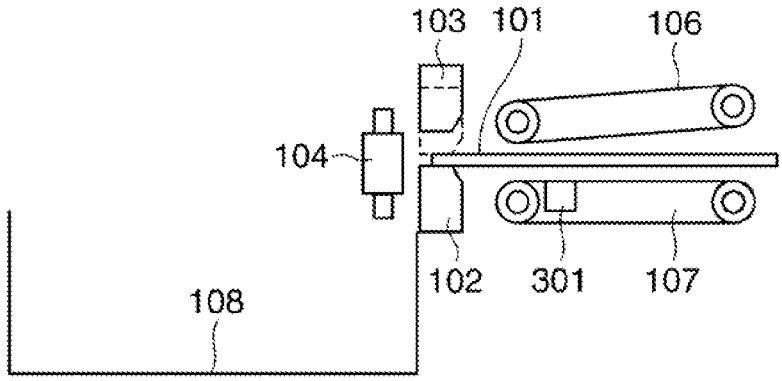
FIGS. 2A, 2B, and 2C are views useful in explaining operations of a flattening process performed by the sheet processing apparatus according to the present embodiment.
Figure 2B:
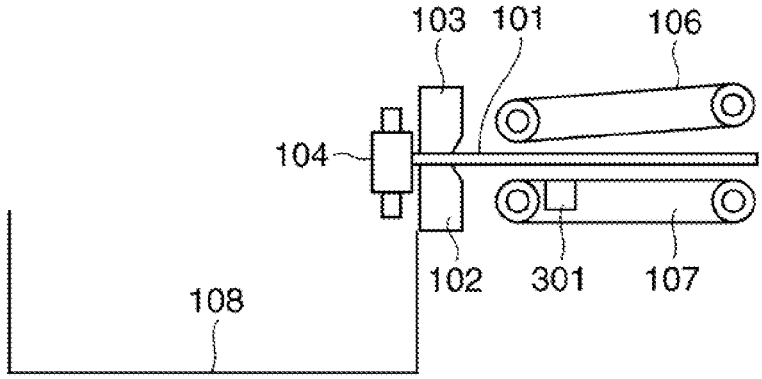

Next, as shown in FIG. 2A, the sheet bundle 101 conveyed to the flattening section 3 is conveyed by conveyance belts 106 and 107 which are driven by a sheet bundle conveyance motor 505 (shown in FIG. 4) configured as a driving conveyance unit. The sheet bundle 101 is stopped after being conveyed to a flattening position at which the sheet bundle 101 is brought into abutment with a pressing roller 104 appearing in FIG. 2B. To this end, based on the results of detection by a sheet bundle detection sensor 301 and a distance over which the sheet bundle conveyance motor 505 has conveyed the sheet bundle 101, the sheet processing apparatus 2 detects that the sheet bundle 101 has approached the flattening position. The distance over which the sheet bundle conveyance motor 505 has conveyed the sheet bundle 101 is determined based on the results of detection by a rotation detection sensor 508 (shown in FIG. 4) mounted on a motor shaft (not shown). Note that the rotation detection sensor 508 forms a conveying distance-detecting unit that detects the conveying distance of the sheet bundle 101.

Next, upon detecting that the sheet bundle 101 has approached the flattening position, the sheet processing apparatus 2 starts a stopping operation for stopping the sheet bundle conveyance motor 505 to, thereby stop the sheet bundle 101 at the flattening position. Note that "to start the stopping operation" means that a CPU 550 of a sheet processing apparatus controller 501, referred to hereinafter, stops a driving signal for driving the sheet bundle conveyance motor 505. At the same time, the sheet processing apparatus 2 controls driving of a clamp motor 506 (shown in FIG. 4) such that a clamping operation by clampers 102 and 103 is terminated when the sheet bundle 101 has reached the flattening position. The clampers 102 and 103 are driven by the clamp motor 506. Synchronization control for synchronizing the operation for stopping the sheet bundle 101 and the clamping operations of the clampers 102 and 103 will be described hereinafter.

Figure 3A:
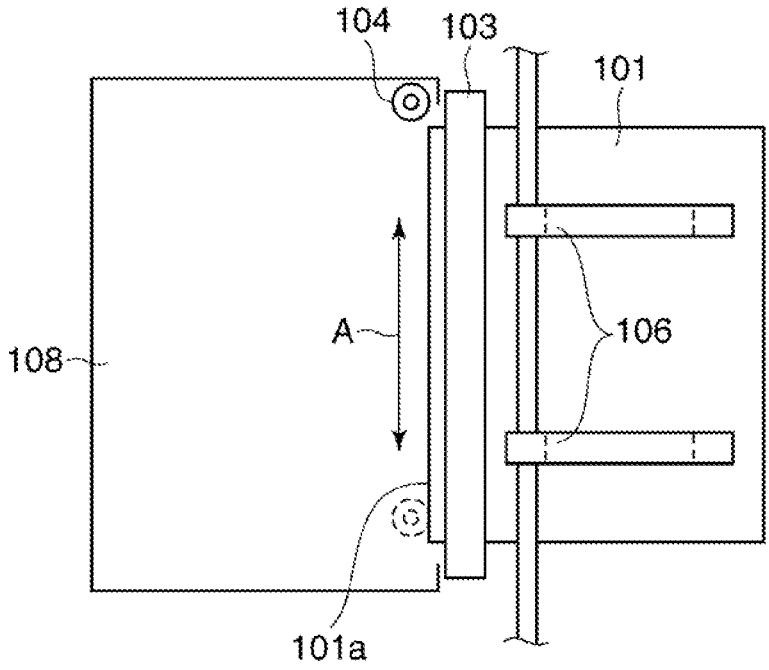
FIGS. 3A and 3B are views useful in explaining the flattening process performed by the sheet processing apparatus according to the present embodiment.

Further, the sheet processing apparatus 2 moves the pressing roller 104 to a position close to the sheet bundle 101 in predetermined timing, as shown in FIG. 3A. Here, the term "predetermined timing" is intended to mean timing of a predetermined time period before the sheet bundle reaches the flattening position or timing after the trailing end of a preceding sheet bundle has passed the flattening position. This makes it possible for the sheet processing apparatus 2 to cause the pressing roller 104 to press the folded spine of each sheet bundle immediately after the sheet bundle has been stopped at the flattening position.

Figure 2C:
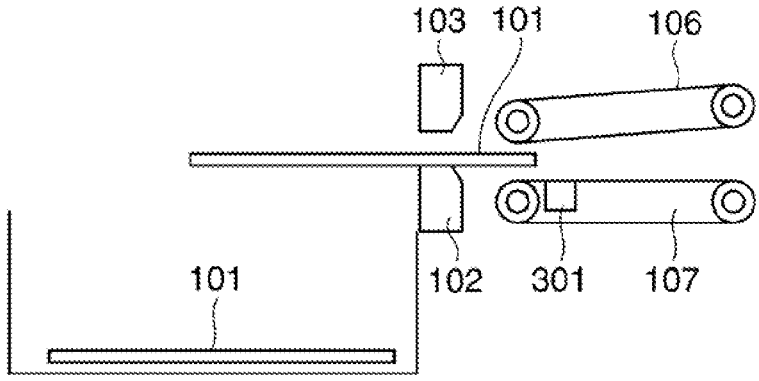
Figure 3B:
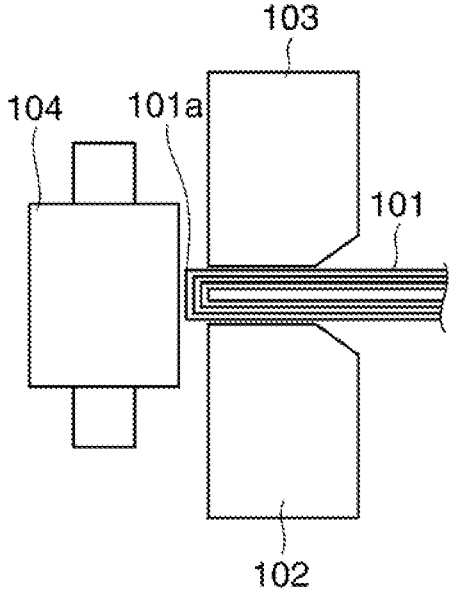

Next, when the sheet processing apparatus 2 performs flattening, the pressing roller 104 at the position close to the sheet bundle 101, as shown in FIG. 3A, travels (moves) in a direction indicated by an arrow A while pressing the curved folded spine 101*a* of the sheet bundle 101. This operation is performed by driving the pressing roller 104 using a press motor 507, whereby the folded spine 101*a* of the sheet bundle 101 is pressed by the pressing roller 104, as shown in FIG. 3B, and is flattened. Then, the sheet bundle 101 having been subjected to the flattening of the folded spine 101*a* is conveyed, as shown in FIG. 2C, and is discharged onto a discharge tray 108.

Next, a control system of the sheet processing apparatus for controlling the above-described flattening will be described with reference to a block diagram shown in FIG. 4.

Figure 4:
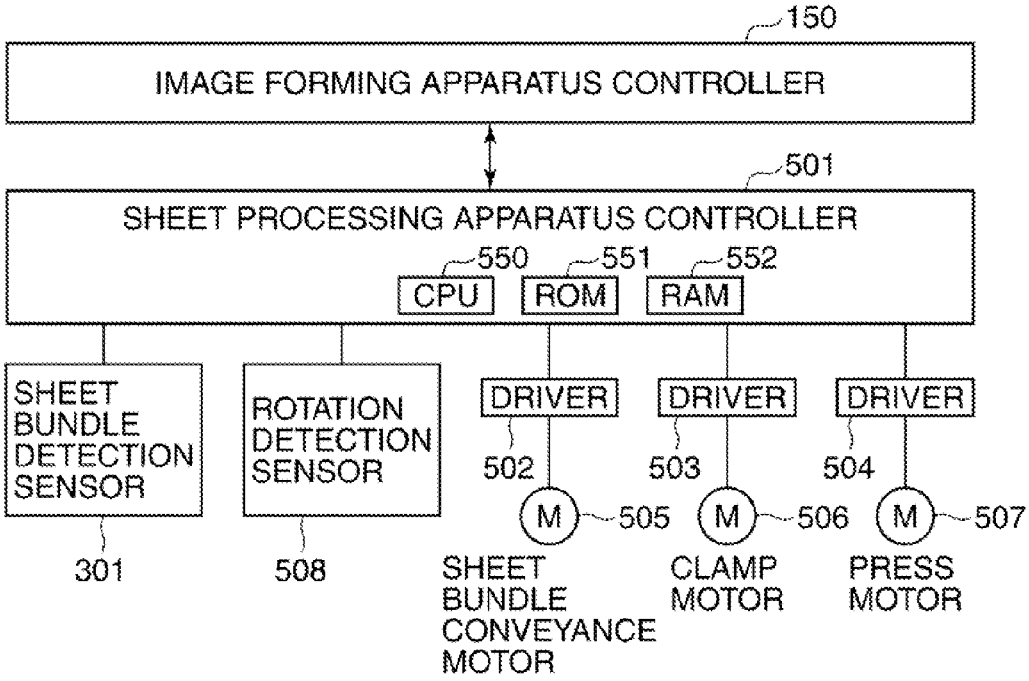
FIG. 4 is a block diagram of a control system of the image forming apparatus including the sheet processing apparatus according to the present embodiment.

In FIG. 4, the sheet processing apparatus controller 501 is mounted e.g. on the sheet processing apparatus 2. The sheet processing apparatus controller 501 includes the CPU 550, a ROM 551 and a RAM 552. The sheet processing apparatus controller 501 communicates with an image forming apparatus controller 150 integrally mounted on the image forming apparatus 1, for data exchange. Further, the sheet processing apparatus controller 501 executes various programs stored in the ROM 551 according to instructions from the image forming apparatus controller 150, to thereby control driving of the sheet processing apparatus 2.

Further, the sheet processing apparatus controller 501 controls the sheet bundle detection sensor 301, the sheet bundle conveyance motor 505, and a driver 502 for driving the sheet bundle conveyance motor 505, and further controls the clamp motor 506 and a driver 503 for driving the clamp motor 506. Further, the sheet processing apparatus controller 501 controls the press motor 507, a driver 504 for driving the press motor 507, and the rotation detection sensor 508.

Figure 5:
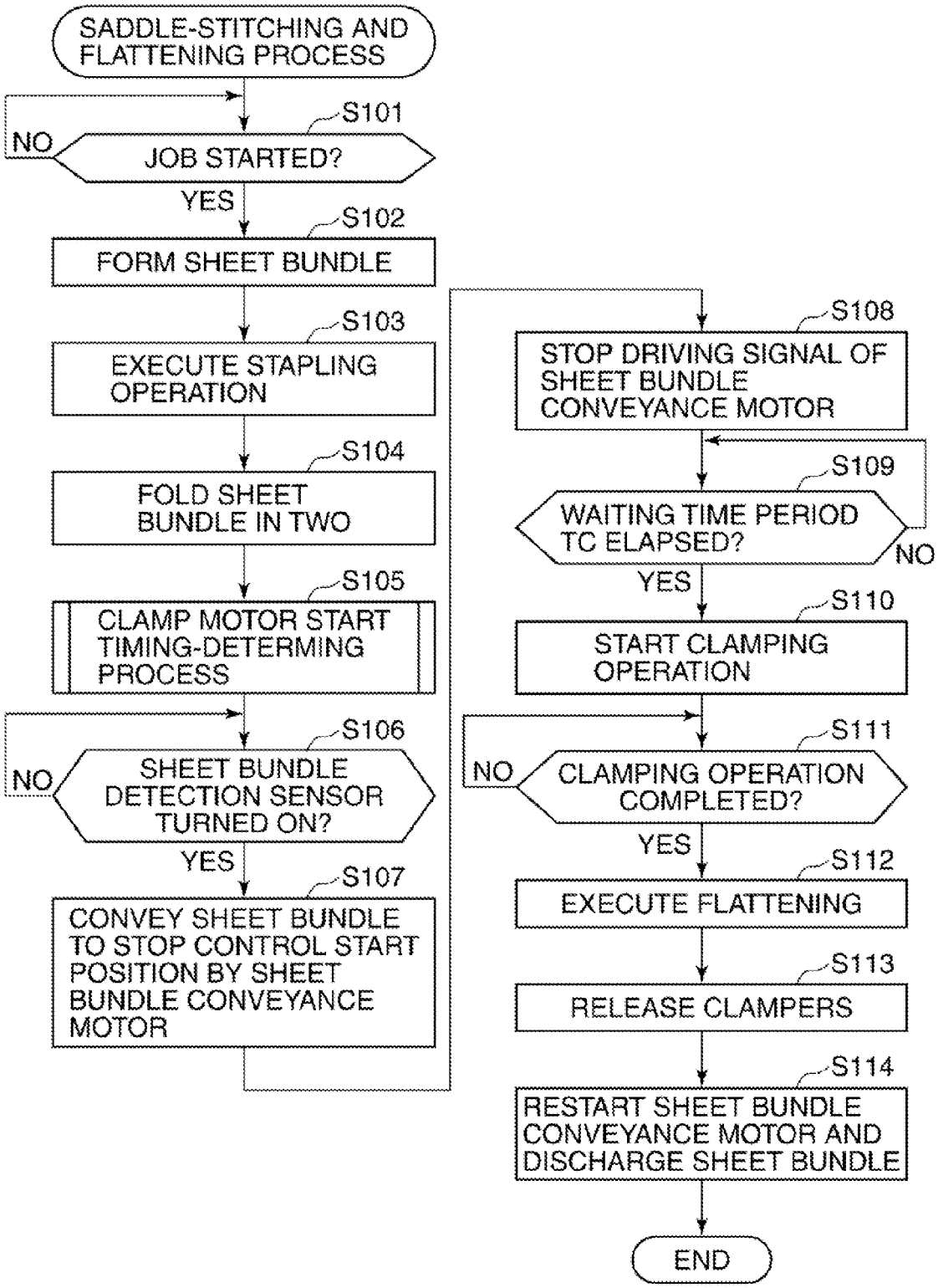
FIG. 5 is a flowchart of a saddle-stitching and flattening process executed by the sheet processing apparatus according to the present embodiment.

Next, a saddle-stitching and flattening process will be described with reference to FIG. 5. Note that the following control is carried out by the CPU 550 of the sheet processing apparatus controller 501 integrally mounted on the image forming apparatus 1, according to an instruction for executing the saddle-stitching and flattening process, which is transmitted from the image forming apparatus controller 150 of the image forming apparatus 1.

The CPU 550 waits (NO to a step S101) until it receives a job start signal for instructing execution of the saddle-stitching and flattening process, from the image forming apparatus controller 150. Upon receipt of the job start signal for instructing execution of the saddle-stitching and flattening process, the CPU 550 starts the saddle-stitching and flattening process (YES to the step S101).

Next, the CPU 550 stacks sheets within the conveying path 34 to form a sheet bundle (step S102). Then, the CPU 550 executes a stapling operation (step S103), and then an operation for folding the sheet bundle in two (step S104). Next, the CPU 550 determines timing for starting the clamp motor 506 that constitutes a holding unit (step S105). Note that a process (clamp motor start timing-determining process) for, determining the timing for starting the clamp motor 506 will be described hereinafter. Further, in the case of a saddle stitching process without the flattening process, sheets are discharged without executing the step 105 et seq.

Next, the CPU 550 waits (NO to a step S106) until the sheet bundle detection sensor 301 is turned on. Then, when determining that the sheet bundle detection sensor 301 has been turned on (YES to the step S106), the CPU 550 starts driving control of the sheet bundle conveyance motor 505 so as to measure timing for stopping the driving of the sheet bundle conveyance motor 505.

Then, the CPU 550 conveys the sheet bundle to a stop control start position suitable for stopping the sheet bundle at the flattening position, according to the driving control for measuring the timing for stopping the driving of the sheet bundle conveyance motor 505 (step S107). The stop control start position is set to such a predetermined location, upstream of the flattening position, at which the distance from the stop control start position to the flattening position is shorter than the distance over which the sheet bundle is moved by inertia after the driving of the sheet bundle conveyance motor 505 is stopped.

Next, the CPU 550 stops the driving signal of the sheet bundle conveyance motor 505 (step S108). After stopping the driving signal, the CPU 550 waits for the lapse of a waiting time period TC which indicates the clamp start timing (step S109). The waiting time period TC is determined in the clamp motor start timing-determining process. Then, the CPU 550 causes the clamp motor 506 to operate upon the lapse of the waiting time period TC to start the clamping operation by the clampers 102 and 103 (step S110).

Then, the CPU 550 waits (NO to a step S111) until the clamping operation is terminated, and when it is determined that the clamping operation is terminated (YES to the step S111), the CPU 550 executes the flattening process (step S112). After termination of the flattening process, the CPU 550 drives the clamp motor 506 to release the clampers 102 and 103 (step S113). Then, the CPU 550 restarts the sheet bundle conveyance motor 505, and discharges the sheet bundle (step S114), followed by terminating the present saddle-stitching and flattening process.

Figure 6:
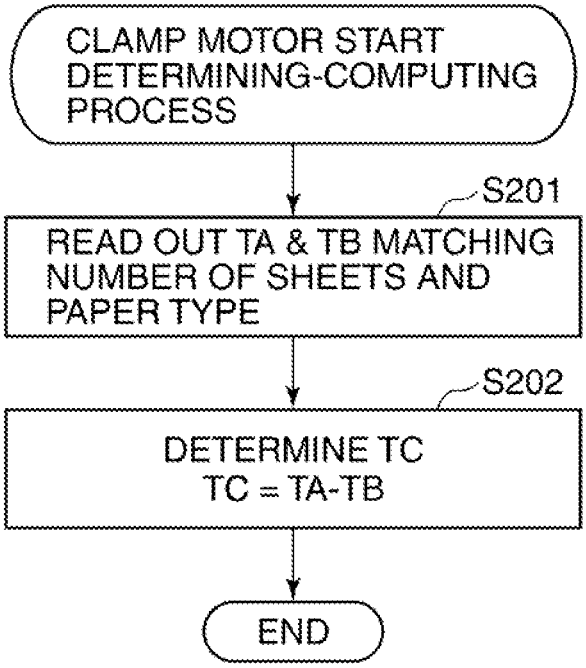
FIG. 6 is a flowchart of a clamp motor start timing-determining process executed by the sheet processing apparatus according to the present embodiment.

Next, the clamp motor start timing-determining process, which is executed in the step 105 of the saddle-stitching and flattening process described with reference to FIG. 5, will be described with reference to FIG. 6. This clamp motor start timing-determining process relates to the stop control for synchronizing the operation for stopping the driving of the sheet bundle conveyance motor 505 and the operation of the clampers 102 and 103, so as to stably stop the sheet bundle at the flattening position.

Figure 7A:
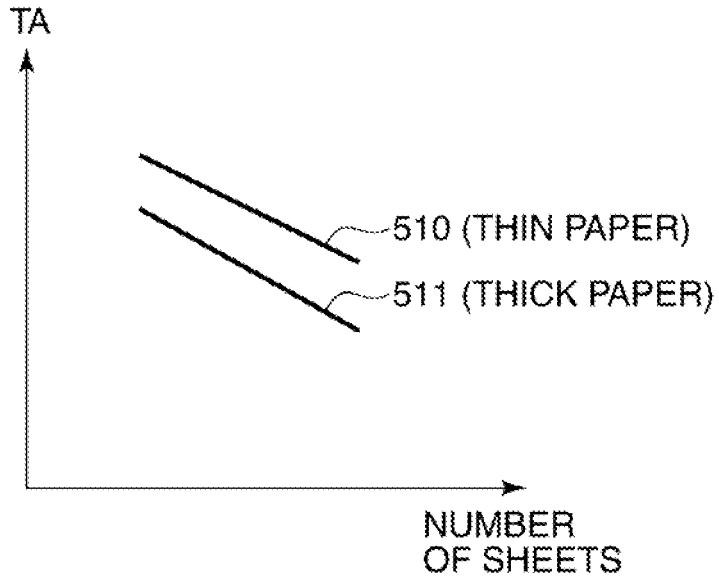
FIGS. 7A and 7B are views useful in explaining characteristics of a stopping operation and a clamping operation of the sheet processing apparatus according to the present embodiment which are performed on a sheet bundle.

First, the relationship between the stopping the driving signal of the sheet bundle conveyance motor, the operation of the clampers, and a sheet bundle will be described with reference to FIGS. 7A and 7B. FIG. 7A shows the relationship between an arrival time TA taken for the sheet bundle to reach a flattening stop position after stopping the driving signal of the sheet bundle conveyance motor 505, the number of sheets of the sheet bundle, and the paper type of the sheet bundle. In FIG. 7A, the vertical axis represents the arrival time. TA, and the horizontal axis, represents the number of sheets of the sheet bundle. Lines denoted by reference numerals 510 and 511 indicate characteristics of thin paper and thick paper, respectively. As the number of sheets of the sheet bundle is larger and the paper is thicker, i.e. the sheet bundle is heavier, the sheet bundle has a larger inertia, and hence the decrease of the moving speed of the sheet bundle after stopping the driving signal is slower. Therefore, as shown in FIG. 7A, as the sheet bundle is heavier, the arrival time TA becomes shorter.

Figure 7B:
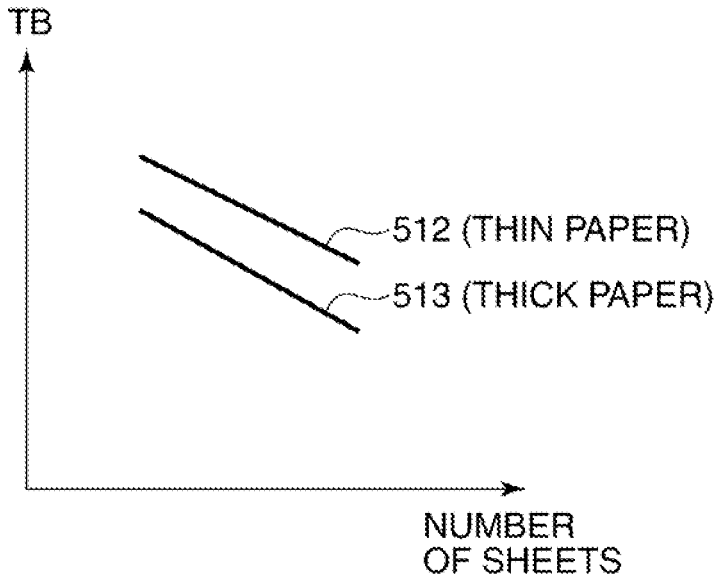

On the other hand, FIG. 7B shows the relationship between a holding time TB taken for the clampers 102 and 103 to hold the sheet bundle after the start of the clamp motor 506, the number of sheets of the sheet bundle, and the paper type of the sheet bundle. In FIG. 7B, the vertical axis represents the holding time TB, and the horizontal axis represents the number of sheets of the sheet bundle. Lines denoted by reference numerals 512 and 513 indicate characteristics of thin paper and thick paper, respectively. As the number of sheets of the sheet bundle is larger and the paper is thicker, i.e. the sheet bundle is thicker, the stroke distance over which each of the clampers 102 and 103 is moved before they are brought into abutment with the sheet bundle becomes shorter. Therefore, as shown in FIG. 7B, as the sheet bundle is thicker, the holding time TB becomes shorter. In the clamp motor start timing-determining process shown in FIG. 6, the CPU 550 reads out the arrival time TA and the holding time TB matching the number of sheets and the paper type of the sheet bundle from the ROM 551 storing in advance the characteristics of thin paper and thick paper illustrated in FIGS. 7A and 7B (step S201).

Next, the CPU 550 determines the waiting time period TC which is to elapse before starting the clamp motor 506 after stopping the driving signal of the sheet bundle conveyance motor 505, based on the difference between TA and TB (step S202). This is with a view to performing the stop control such that the holding of the sheet bundle by the clampers 102 and 103 is completed when the sheet bundle has reached the flattening position. In the case where the stop control for synchronizing the operation for stopping the sheet bundle and the clamping operation is performed as described above, the sheet bundle can be held with the clampers 102 and 103 when the sheet bundle has reached the flattening position. This makes it possible for the sheet processing apparatus 2 to stabilize the stop position of the sheet bundle which would otherwise vary with the number of sheets and the paper type of the sheet bundle. Further, the sheet processing apparatus 2 holds the sheet bundle with the clampers 102 and 103, whereby it is capable of suppressing variation in the stop position of the sheet bundle, which would otherwise be caused due to a play of a driving mechanism therefor.

In short, the image forming apparatus provided with the sheet processing apparatus according to the present embodiment is configured to convey a sheet bundle 101 into the flattening section 3 provided in the sheet processing apparatus, such that the sheet bundle 101 can be properly clamped at the flattening position.

In the sheet processing apparatus 2, when the conveyed sheet bundle 101 is brought into abutment with the pressing roller 104 moved in advance to a position corresponding to the flattening position, the sheet bundle 101 is positioned by being held by the clampers 102 and 103. Thus, the sheet processing apparatus 2 performs control for synchronizing an operation for conveying and stopping the sheet bundle 101 and the operation of the clampers 102 and 103.

To control the conveyance of the sheet bundle 101 to the flattening position, the sheet processing apparatus 2 is provided with the sheet bundle detection sensor 301 which is disposed at a predetermined intermediate position of the conveyance belts 106 and 107 constituting a conveyance unit for conveying the sheet bundle 101, in the conveying direction of the sheet bundle. The sheet bundle detection sensor 301 is configured to turn on when it has detected the leading edge of the sheet bundle 101 in the conveying direction.

The sheet processing apparatus 2 is configured to be capable of detecting the conveying distance of the sheet bundle 101 with the rotation detection sensor 508 mounted on a shaft, not shown, of the sheet bundle conveyance motor 505 that drives the conveyance belts 106 and 107 constituting the conveyance unit. In the sheet processing apparatus 2, the sheet processing apparatus controller 501, which forms an information detection unit that detects information on the weight of the sheet bundle, acquires information on the number of sheets of the sheet bundle 101 and information as to whether the sheets are of thin paper or of thick paper, from the image forming apparatus controller 150. Note that the arrangement for acquiring the above information may be implemented in a manner such that a user sets sheet bundle information using e.g. the operation and display unit 15 of the image forming apparatus 1. More specifically, the sheet bundle information can be set by the user who operates the operation and display unit 15 to set the information of the number of sheets of the sheet bundle 101 and the information as to whether the sheets are thin paper or thick paper. Alternatively, the sheet processing apparatus 2 may be configured, for example, such that three categories of sheets made of plain paper, thicker paper, and thickest paper can be set for sheet weights, and two categories of sheets made of ordinary paper and coat paper can be set as sheet materials. Note that the sheets may be categorized more finely or more broadly, as required. Further, to acquire the weight of the sheet bundle 101, the sheet processing apparatus 2 may be provided with a sheet bundle thickness-detecting sensor for detecting the thickness of the sheet bundle 101 being conveyed by the conveyance belts 106 and 107. Furthermore, the sheet processing apparatus 2 may be provided with an information-detecting arrangement for detecting information on the weight, the material, or the number of sheets.

In the sheet processing apparatus 2, the CPU 550 acquires the arrival time TA taken for the sheet bundle to reach the flattening stop position after stopping the driving signal of the sheet bundle conveyance motor 505, using data of the paper characteristics shown in FIG. 7A and the like, as described above. As the sheet bundle becomes heavier, it has a larger inertia, and hence the decrease of the moving speed of the sheet bundle is slower. Therefore, as the sheet bundle is heavier, the arrival time TA becomes shorter. Note that these characteristics are empirically determined in advance e.g. by experiment. Further, the CPU 550 acquires the holding time TB taken for the clampers 102 and 103 to hold the sheet bundle after the start of the clamp motor 506, using data of the paper characteristics shown in FIG. 7B, as described above. As the sheet bundle becomes thicker, the stroke distance over which each of the clampers 102 and 103 is moved becomes shorter, and hence the holding time TB becomes shorter as the sheet bundle becomes thicker. Note that these characteristics are empirically determined in advance e.g. by experiment. Note that the arrival time TA and the holding time TB are determined based on information on the number of sheets of the sheet bundle 101 and information as to whether the sheets are of thin paper or of thick paper.

In the sheet processing apparatus 2 configured as above, when the sheet bundle 101 is formed and an operation for conveying the sheet bundle 101 into the flattening section 3 is started, the CPU 550 executes the clamp motor start timing-determining process. In this clamp motor start timing-determining process, first, the CPU 550 reads out the arrival time TA and the holding time TB matching the number of sheets and the paper type of the sheet bundle 101 from the ROM 551 storing in advance the characteristics illustrated in FIGS. 7A and 7B. Then, in the clamp motor start timing-determining process, the CPU 550 determines the waiting time period TC which is to elapse before starting the clamp motor 506 after the start of a control operation for stopping the sheet bundle, based on the difference between the arrival time TA and the holding time TB.

Next, the CPU 550 determines a stop control start position suitable for the sheet bundle 101 being conveyed to stop at the flattening position, based on timing at which the sheet bundle detection sensor 301 has been turned on, and determines timing at which the sheet bundle 101 reaches the determined stop control start position. Then, the CPU 550 stops the driving signal of the sheet bundle conveyance motor 505 at the determined timing. The stop control start position is a position at which the control for stopping the conveyance belts 106 and 107 conveying the sheet bundle 101 is started. Here, the sheet bundle 101 having been conveyed by the conveyance belts 106 and 107 is moved for a time lag before the conveying operation of the conveyance belts 106 and 107 is stopped, and at the same time is moved by the inertia of the sheet bundle 101. Therefore, in the sheet processing apparatus 2, the stop control start position is empirically determined in advance e.g. by experiment such that if the driving signal of the sheet bundle conveyance motor 505 is stopped at the stop control start position, the sheet bundle 101 is stopped at the flattening position or a position slightly beyond the flattening position.

Next, the CPU 550 executes the stop control for driving the clamp motor 506 to start the clamping operation after the lapse of the waiting time period TC which indicates the clamp start timing and is determined in the clamp motor start timing-determining process. In the sheet processing apparatus 2, the CPU 550 performs the above-described control, whereby the sheet bundle 101 is conveyed by the conveyance belts 106 and 107, and is stopped in a state in which the leading end of the sheet bundle 101 is brought into abutment with the pressing roller 104. In synchronism therewith, the leading end of the sheet bundle 101 brought into abutment with the pressing roller 104 is sandwiched by the clampers 102 and 103.

In the sheet processing apparatus 2, the CPU 550 carries out the stop control, as described above, thereby making it possible to stabilize the stop position of the sheet bundle, which would otherwise vary with the number of sheets and the paper type of the sheet bundle. Further, in the sheet processing apparatus 2, by sandwiching the sheet bundle with the clampers 102 and 103, it is also possible to suppress variation in the stop position of the sheet bundle, which would otherwise be caused due to the play of the driving mechanism. Further, in the sheet processing apparatus 2, the flattening is performed on the sheet bundle 101 sandwiched by the clampers 102 and 103. In this flattening, the CPU 550 drivingly controls the press motor 507, whereby the pressing roller 104 located at the flattening position travels (moves) in the direction indicated by the arrow A along the curved folded spine 101*a* of the sheet bundle 101. This operation causes the pressing roller 104 to press and favorably flatten the folded spine 101*a* of the sheet bundle 101.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2011-075645 filed Mar. 30, 2011, and Japanese Patent Application No. 2012-064027 filed Mar. 21, 2012, which are hereby incorporated by reference herein in their entirety.

What is claimed is:

1. A sheet processing apparatus that flattens a curved folded spine which is a bent portion of a folded sheet bundle formed by folding sheets stacked one upon another, comprising:

a conveyance unit configured to convey the sheet bundle to a flattening position at which flattening of the folded spine of the sheet bundle is performed;

a flattening unit configured to press the folded spine of the sheet bundle positioned at the flattening position to thereby flatten the folded spine;

a holding unit provided independently of said conveyance unit and configured to hold the sheet bundle such that the sheet bundle is not moved when said flattening unit performs flattening; and a control unit configured to stop a driving signal for driving said conveyance unit when the sheet bundle is conveyed to a predetermined location upstream of the flattening position in a conveying direction of the sheet bundle, and hold the sheet bundle with said holding unit before the conveyance of the sheet bundle is stopped, to thereby stop the sheet bundle at the flattening position.

2. The sheet processing apparatus according to claim 1, wherein as a thickness of the sheet bundle is larger, said control unit makes timing earlier in which said holding unit starts to hold the sheet bundle.

3. The sheet processing apparatus according to claim 1, wherein as a weight of the sheet bundle is heavier, said control unit makes timing earlier in which said holding unit starts to hold the sheet bundle.

4. The sheet processing apparatus according to claim 1, wherein said control unit determines timing for starting driving of said holding unit, based on a difference between a time period from a time point when the driving signal is stopped to a time point when the sheet bundle reaches the flattening position and a time period from a time point when driving of said holding unit is started to a time point when said holding unit holds the sheet bundle.

5. A sheet processing apparatus that flattens a curved folded spine which is a bent portion of a folded sheet bundle formed by folding sheets stacked one upon another, comprising:

a conveyance unit configured to convey the sheet bundle to a flattening position at which flattening of the folded spine of the sheet bundle is performed;

a holding unit configured to hold the sheet bundle conveyed to the flattening position by said conveyance unit;

a sheet bundle detection sensor that detects the sheet bundle being conveyed by said conveyance unit;

a conveyance control unit configured to determine timing for starting a stop control for stopping the sheet bundle at the flattening position based on detection of the sheet bundle by said sheet bundle detection sensor, and stop a driving signal for driving said conveyance unit at the determined timing;

an sheet bundle information acquisition unit configured to acquire information on the sheet bundle;

an arrival time acquisition unit configured to acquire an arrival time taken for the sheet bundle to reach the flattening position after a time point when said conveyance control unit stops the driving signal, based on the information on the sheet bundle acquired by said sheet bundle information acquisition unit;

a holding time acquisition unit configured to acquire a holding time taken for said holding unit to hold the sheet bundle after a time point when said holding unit starts an operation for holding the sheet bundle, based on the information on the sheet bundle acquired by said sheet bundle information acquisition unit; and a holding control unit configured to cause said holding unit to start a clamping operation, based on a difference between the arrival time acquired by said arrival time acquisition unit and the holding time acquired by said holding time acquisition unit, to thereby cause the sheet bundle to be held and stopped at the flattening position.

6. An image forming apparatus comprising:

an image forming unit configured to form an image on a sheet;

a folding unit configured to fold a sheet bundle formed by a plurality of sheets each having images formed thereon by said image forming unit;

a conveyance unit configured to convey the sheet bundle to a flattening position at which flattening of a folded spine of the sheet bundle folded by said holding unit is performed;

a flattening unit configured to press the folded spine of the sheet bundle positioned at the flattening position to thereby flatten the folded spine;

a holding unit provided separately from said conveyance unit and configured to hold the sheet bundle such that the sheet bundle is not moved when said flattening unit performs flattening; and a control unit configured to stop a driving signal for driving said conveyance unit when the sheet bundle is conveyed to a predetermined location upstream of the flattening position in a conveying direction of the sheet bundle, and hold the sheet bundle with said holding unit before the conveyance of the sheet bundle is stopped, to thereby stop the sheet bundle at the flattening position.

* * * * *